US009085853B2

(12) United States Patent
Trani et al.

(10) Patent No.: US 9,085,853 B2
(45) Date of Patent: Jul. 21, 2015

(54) MULTIFUNCTION APPARATUS FOR PROCESSING WEBS OF FIBROUS AND/OR PLIABLE MATERIAL

(71) Applicant: Giorgio Trani, Venice (IT)

(72) Inventors: Giorgio Trani, Venice (IT); Marion Sterner, Venice (IT)

( * ) Notice: Subject to any disclaimer, the term of this patent is extended or adjusted under 35 U.S.C. 154(b) by 0 days.

(21) Appl. No.: 14/359,866

(22) PCT Filed: Nov. 29, 2012

(86) PCT No.: PCT/IB2012/002537

§ 371 (c)(1),
(2) Date: May 21, 2014

(87) PCT Pub. No.: WO2013/080022

PCT Pub. Date: Jun. 6, 2013

(65) Prior Publication Data

US 2014/0345823 A1 Nov. 27, 2014

(30) Foreign Application Priority Data

Nov. 30, 2011 (IT) ..... VE11A0077

(51) Int. Cl.

| | |
|---|---|
| ***D21H 25/04*** | (2006.01) |
| ***B31F 1/00*** | (2006.01) |
| ***D21F 1/00*** | (2006.01) |
| ***B31F 1/12*** | (2006.01) |
| ***B31F 1/16*** | (2006.01) |
| ***B31F 1/18*** | (2006.01) |
| ***D21H 25/00*** | (2006.01) |
| ***D21F 1/48*** | (2006.01) |

(52) U.S. Cl.

CPC ..... *D21F 1/009* (2013.01); *B31F 1/122* (2013.01); *B31F 1/128* (2013.01); *B31F 1/16* (2013.01); *B31F 1/18* (2013.01); *D21F 1/48* (2013.01); *D21H 25/005* (2013.01)

(58) Field of Classification Search

CPC ..... B31F 1/18; B31F 1/122; B31F 1/128; B31F 1/16; D21F 1/009; D21F 1/48; D21H 25/005; D21H 5/02

See application file for complete search history.

(56) References Cited

U.S. PATENT DOCUMENTS

| | | | | |
|---|---|---|---|---|
| 2,535,734 | A | 12/1950 | Grettve | |
| 6,024,832 | A * | 2/2000 | Trani et al. | 162/13 |
| 7,918,966 | B2 * | 4/2011 | Trani et al. | 162/203 |
| 8,603,299 | B2 * | 12/2013 | Trani et al. | 162/361 |
| 2002/0100256 | A1 * | 8/2002 | Trani et al. | 53/452 |
| 2004/0137233 | A1 * | 7/2004 | Trani et al. | 428/423.1 |
| 2011/0126997 | A1 * | 6/2011 | Trani et al. | 162/202 |
| 2014/0262096 | A1 * | 9/2014 | Trani et al. | 162/197 |
| 2014/0345823 | A1 * | 11/2014 | Trani et al. | 162/363 |

FOREIGN PATENT DOCUMENTS

| | | | | |
|---|---|---|---|---|
| WO | WO 02/94915 | A2 * | 11/2002 | C08J 7/04 |
| WO | 2010015614 | | 2/2010 | |
| WO | WO 2010015614 | A1 * | 2/2010 | B31F 1/12 |

* cited by examiner

*Primary Examiner* — Jose Fortuna
(74) *Attorney, Agent, or Firm* — Themis Law

(57) ABSTRACT

A multifunction apparatus for processing webs of fibrous and/or pliable material includes a tubular sleeve of an elastic material, a pair of discs supporting the tubular sleeve, a fixed shaft on which the discs are mounted such that their axis is inclinable to the axis of the sleeve, the end portions of the shaft extending beyond said discs, and a system moving the disc/sleeve system relative to the shaft.

14 Claims, 4 Drawing Sheets

MULTIFUNCTION APPARATUS FOR PROCESSING WEBS OF FIBROUS AND/OR PLIABLE MATERIAL

FIELD OF THE INVENTION

The present invention relates to a multifunction apparatus for processing webs of fibrous and/or pliable material.

BACKGROUND OF THE INVENTION

Production methods for fibrous and/or pliable material are known, in particular for webs of paper, fabric, hide, etc. In the case of fibrous materials the production methods generally consist of pouring a mix of fibrous material and water onto an endless conveyor belt in movement. Here the mix is progressively deprived of its water content and subjected to a series of traditional processes which finally lead to the obtaining of a paper web or, in more general terms, to the obtaining of a web of fibrous material, to be then fed to subsequent uses.

These subsequent uses can consist of printing on the paper web or its transformation by suitable successive passages, for example on paper processing machines, etc.

As the production process requires the fibrous web to undergo a lengthy path it is advantageous to utilize this path to obtain further modifications which increase the value of the fibrous web in addition for example to the removal of water. To this end, one solution consists of introducing during the path one or more modules which enable paper webs with improved physical characteristics to be produced, for example extendable in the transverse direction. They are generally combined with a method for producing paper webs also extendable in the longitudinal direction, hence enabling paper webs to be produced extendable in all directions.

One of these known methods, described in U.S. Pat. No. 2,535,734, causes a paper web to adhere to an endless elastic belt which is in the process of contracting. This method uses either open endless belts which are of considerable length or elastic tubes mounted on inclined discs fixed on a jointed movable shaft which, by rotating, enlarge or contract the elastic surface. In this latter case the space within the sleeve is inaccessible from the outside, the rotary movement being impressed by the jointed movable shaft on the discs fixed to it. The compact apparatus provided with an elastic tube described in U.S. Pat. No. 2,535,734 cannot perform operations other than transverse compression; moreover it is not specified whether it can treat the paper during the formation process in a continuous machine.

SUMMARY OF THE INVENTION

An object of the invention is to produce a web of fibrous material having fibre orientation which is more homogeneous and less unbalanced in the machine direction and consequently with more isotropic properties (mechanical, hygroscopic, dimensional stability, etc).

Another object of the invention is an apparatus enabling the width of a continuous web of fibrous material to be modified, and more particularly of a continuous paper web, and to ensure the stability of the web modified in this manner.

Another object of the invention is to produce a web of fibrous material of high "voluminosity," in the sense of its thickness/surface density ratio.

Another object of the invention is to produce a continuous web of fibrous material of thickness less than the minimum obtainable with traditional paper processing machines and with a more homogeneous fiber distribution for equal surface density, including at low surface densities.

Another object of the invention is to propose a method and apparatus for producing, at a high production rate, webs of fibrous material, in particular paper, able to be extended transversely and possibly longitudinally.

Another object of the invention is to propose a method and apparatus which enable wrinkles to be widened out and removed effectively from natural or synthetic fabrics.

Another object of the invention is to propose a method and apparatus which enable wrinkles to be stretched and removed effectively from natural or synthetic fabrics or paper.

Another object of the invention is to propose a method and apparatus which enable wrinkles to be stretched and removed effectively from natural or synthetic hide.

Another object of the invention is to propose a method and apparatus which enable aluminum to be effectively embossed.

Another object of the invention is to propose a method and apparatus which enable a polymer film to be stretched and orientated, preferably at controlled temperature.

All these objects are attained according to the invention by a multifunction apparatus for processing webs of fibrous and/or pliable material as described hereinafter.

BRIEF DESCRIPTION OF THE DRAWINGS

Some preferred embodiments of the present invention are described hereinafter with reference to the accompanying drawings, in which.

DETAILED DESCRIPTION OF EMBODIMENTS OF THE INVENTION

Figure 1:
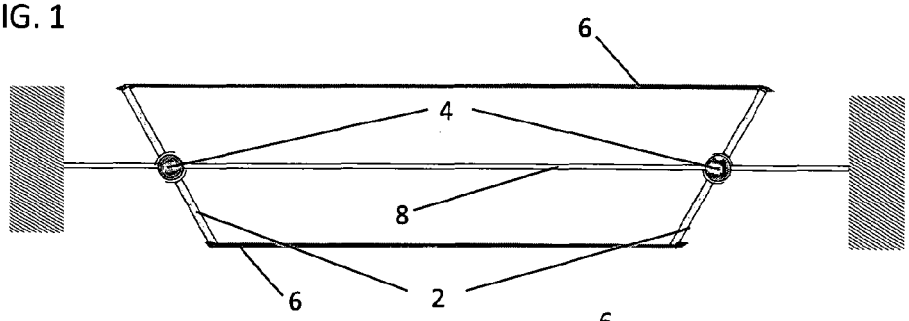
FIG. 1 is a schematic section through a first embodiment of the apparatus according to the invention.
Figure 2:
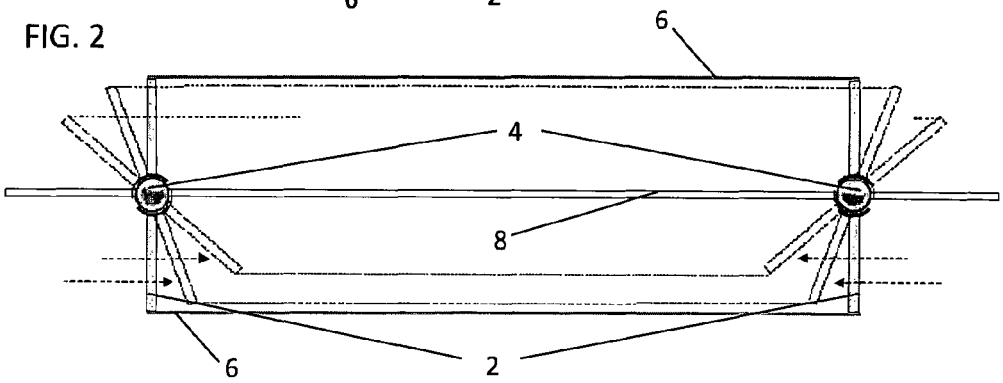
FIG. 2 shows it in the same view in different possible configurations.
Figure 3:
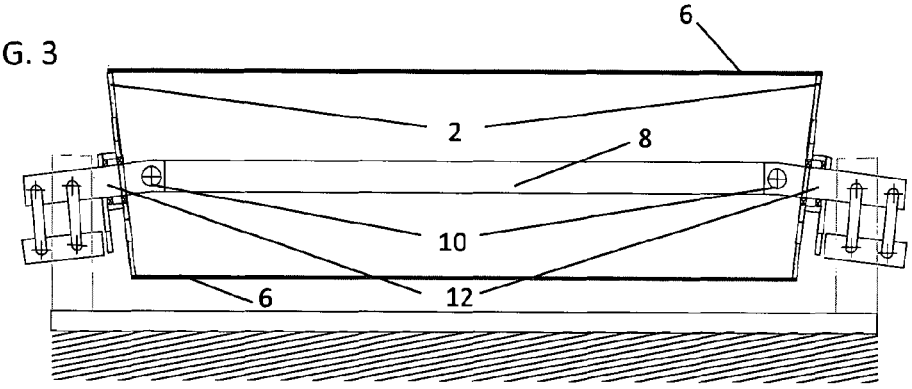
FIG. 3 shows a second embodiment thereof in the same view.

As can be seen from the figures, the apparatus of the invention can operate both independently and in-line on a web of fibrous and/or pliable material, at the optimal point to obtain the required modifications. In the case of a fibrous web it can have a dry content between 3% and 80% and hence a moisture content between 20% and 97%. The web of pliable material can for example be obtained from an already formed paper web subjected previously to wetting to achieve the desired moisture level. Alternatively, the web can be formed instantaneously from a cellulose fiber suspension on a continuous machine in which the apparatus of the invention can be inserted at different points, including several times, in modular manner. The web can also consist of cellulose fibers if a paper web is to be obtained, or of cellulose and polymer fibres or only polymer fibers, if a non-woven fabric is to be obtained, FIG. 1 shows the apparatus of the invention. The discs 2 of the apparatus are made to rotate synchronously while maintaining the inclination of the geometrical axes, about which said discs rotate, constant relative to the axis of the elastic sleeve 6. This is possible by virtue of the systems 4 for joining the discs to the fixed shaft 8. In FIG. 2 the discs are mounted on the fixed shaft 8 by axial ball joints or by rolling bearings hinged on said shaft. FIG. 3 shows an alternative embodiment in which the fixed shaft 8 presents joints 10 enabling the ends 12 to be positioned at an angle to the axis of the elastic sleeve 6, the discs 2 being free to rotate about said angled segments.

Figure 4:
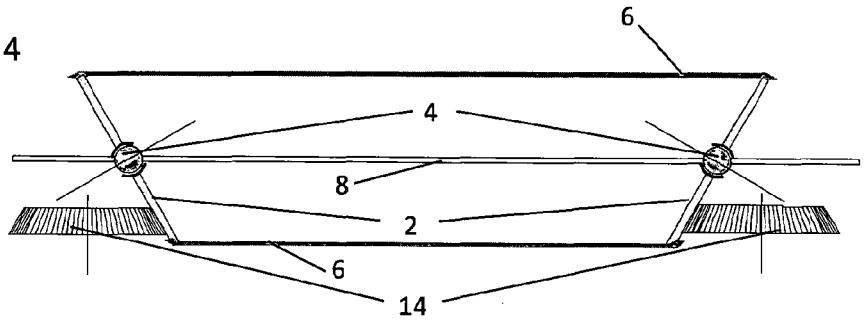
FIG. 4 shows a third embodiment thereof in the same view.
Figure 5:
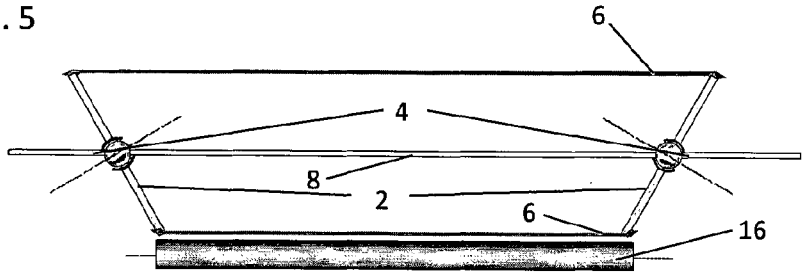
FIG. 5 shows a fourth embodiment thereof in the same view.

In all cases the connected discs 2 are rotated by a motor device which can consist for example of two synchronous motors 14 (FIG. 4) or a roller 16 which entrains them together with the sleeve (FIG. 5).

The sleeve 6 can be fixed to the external surfaces of the discs by flanges or, preferably, be provided with recesses which insert into notches in the edge of the discs, to which they adhere by elastic pressure.

The sleeve 6 can consist of one or more elastomer layers, possibly expanded, or of single or multiple fabric from yarns, solid and/or hollow, elastic or non-elastic but woven with an elastic weave, or finally of a composite layer of the preceding.

The sleeve 6 can also be permeable to fluids (such as in FIGS. 6 and 7) and/or contain a spongy layer or tubular systems able to absorb and/or release and/or circulate fluids in its interior.

Figure 6:
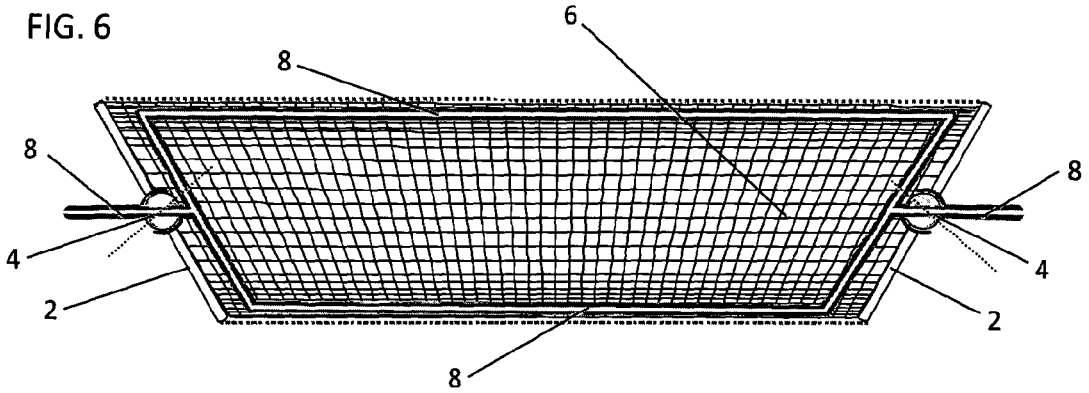
FIG. 6 shows a fifth embodiment thereof in the same view.
Figure 7:
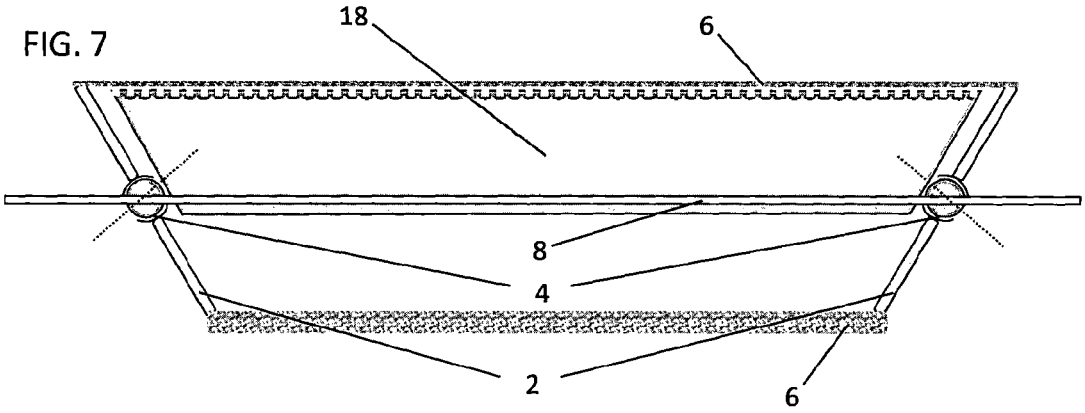
FIG. 7 shows a sixth embodiment thereof in the same view.

It should be noted that the fixed shaft 8, which can be solid or hollow, enables a well stabilized structure to be obtained within a wide range of angles of inclination of the moving discs. The shaft, being fixed, can have a variable diameter, or indeed variable geometric shapes or have bends and elbows according to requirements. In FIG. 6 the fixed shaft 8 is divided into two hollow tubes which can be provided with nozzles able to blow air or atomize liquids through the elastic sleeve 6 formed with a fluid-permeable elastic mesh. In the embodiment shown in FIG. 6 the fixed shaft 8 for example support nozzles to blow air jets into the required points, including at controlled temperature, through the permeable elastic surface and the web adhering to it To maintain adhesion between the web and the elastic sleeve surface, one or more rollers can be used, provided with a covering of soft material to prevent excessive squashing of the web. Immediately before and immediately after the nip with a soft roller, the elastic surface can curve under the force of the air to prevent detachment from the web. The air flow also passing through the web dries it and can improve its voluminosity. The outer surface of the sleeve could also carry a marking to impress on the web. The air flow from the interior can also be used to detach the web from the surface of the elastic sleeve at the suitable moment or be in the form of a blade of air to crinkle the web. If the sleeve 6 is made of fluid-permeable material the fixed shaft 8 can be utilized (FIG. 7) to face the mouth of an aspirator 18 in a position corresponding to a fixed and well defined section of the surface of the elastic sleeve 6; in this manner a good adherence of the web to the sleeve can be achieved, together with a good removal of any moisture contained therein. The use of an internal suction box to achieve adherence avoids having to squeeze the web onto the elastic surface by for example a felt pad and enables more voluminous final products to be obtained.

A suction mouth on the fixed shaft stably centered on a portion of the sleeve surface can maintain a fibrous web adhering while subjected to tangential air blades to increase its voluminosity or to redistribute the fibers. The combination of external air blade and internal suction at the sleeve could be used to crinkle the web longitudinally.

By means of the fixed shaft and/or the devices mounted on it, the temperature and moisture content of the web can be controlled by introducing cold or hot air, steam, water at controlled temperature, or by heated and/or radiant heat surfaces, or by sources of infrared rays, microwaves or radiofrequency waves. Devices can also be mounted to produce magnetic fields or to spray or atomize solutions of additives through the permeable elastic sleeve.

Mechanisms can be implemented on the discs or in the elastic sleeve to produce mechanical vibrations, possibly up to ultrasound level, at the surface of the elastic sleeve to facilitate a more homogeneous rearrangement of the fibres or the penetration of additives or the removal of water.

By using for example a heating system (based on a thermal fluid or on infrared rays, microwaves, etc.) inside the sleeve and/or supported on the fixed shaft, the action of additional additives on the paper can be activated or accelerated, for example expanding agents or moisture resistant resins.

As can be seen from the accompanying figures, the apparatus of the invention can operate with the discs 2 inclined to the fixed shaft, preferably but not necessarily symmetrically, by virtue of the action for example of lateral pushers. The elastic sleeve 6 mounted on the discs 2 and taut between them counterbalances the action of the pushers. In this manner a zone is created in which the elastic material of the sleeve is more stretched and elongated, together with a diametrically opposite zone in which, although the material is taut, the elastic deformation is less.

Figure 8:
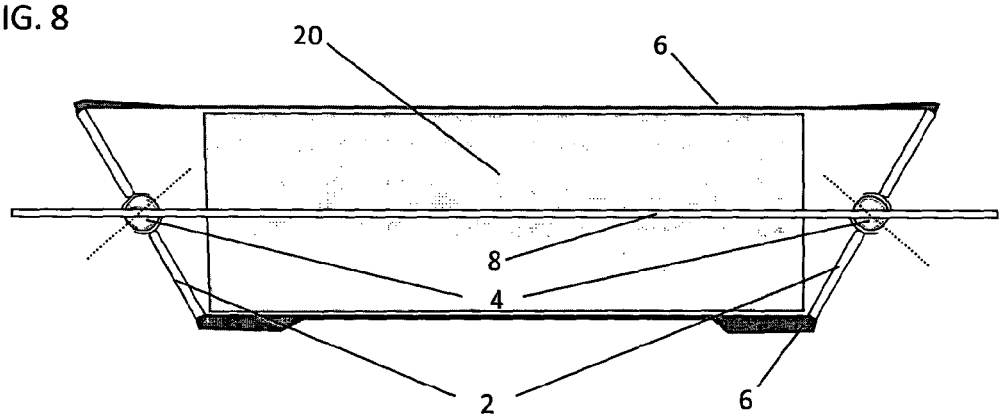
FIG. 8 shows a seventh embodiment thereof in the same view.
Figure 9:
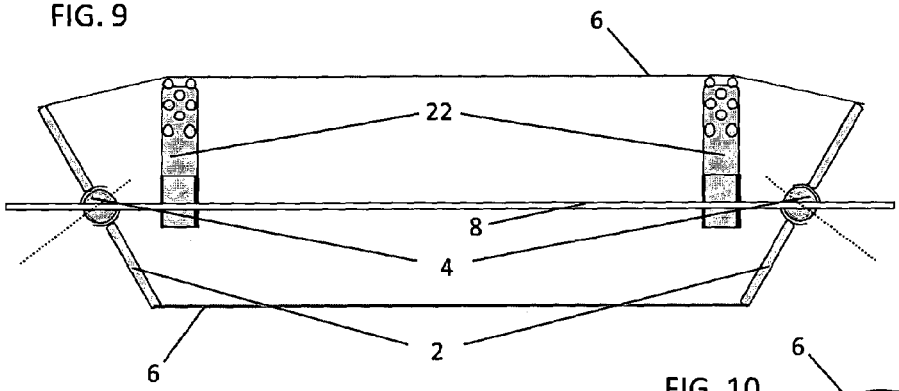
FIG. 9 shows an eighth embodiment thereof in the same view.
Figure 10:
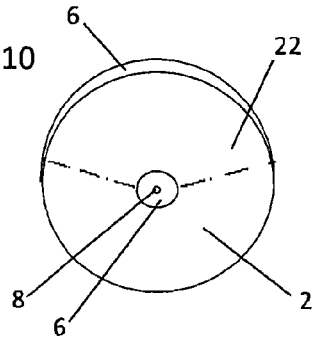
FIG. 10 is a lateral view of the embodiment of FIG. 9.
Figure 11:
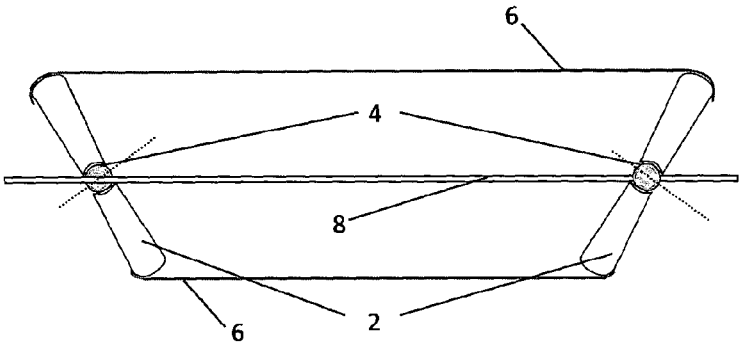
FIG. 11 is a section through a ninth embodiment thereof.
Figure 12:
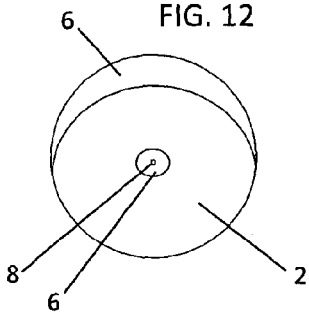
FIG. 12 is a lateral view of the embodiment of FIG. 11.

In FIG. 8 the sleeve 6 has a thickness greater in the lateral zones to increase elastic deformation in the central zone. On the fixed shaft a support surface 20 for the elastic sleeve 6 can also be fixed which takes account of the effective cross-section (ellipsoidal) assumed thereby after inclination of the discs. Alternatively, as shown in FIGS. 9 and 10, suitably shaped pushers 22 provided with ball bearings can be mounted on the fixed shaft 8 to control the curvature of a portion of the surface of the elastic sleeve 6 during rotation of the discs 2 (FIG. 10). As a further alternative, shown in FIGS. 11 and 12, the edge of the discs 2 can also have a spherical cross-section such as to maintain the cross-section of the sleeve 6 round with any inclination (FIG. 12).

By operating in this manner a single axial portion of the sleeve extending transversely from disc to disc continuously passes from maximum to minimum deformation and vice versa during the rotary movement.

By operating with the discs inclined, the web is brought into contact with the surface of the rotating sleeve. If the web is to be compressed transversely, the sleeve comes into contact with the zone of maximum transverse deformation and is detached at the point of minimum deformation. If the web is to be stretched it is brought into contact with the zone of minimum transverse deformation and is detached in that of maximum deformation. If fibre orientation is to be optimized, the web is made to adhere at the point of minimum deformation and is made to follow it through the entire revolution via the maximum deformation until again arriving at the minimum point. In this case the tendency of a fibrous web to absorb or expel liquid while being respectively stretched or compressed can be utilized to add additives or to dry it.

Independently of the manner of use, once the web of fibrous and/or pliable material has been made to adhere to a sleeve surface zone, this latter, during its widening or restriction, also entrains said web of fibrous and/or pliable material.

Figure 13:
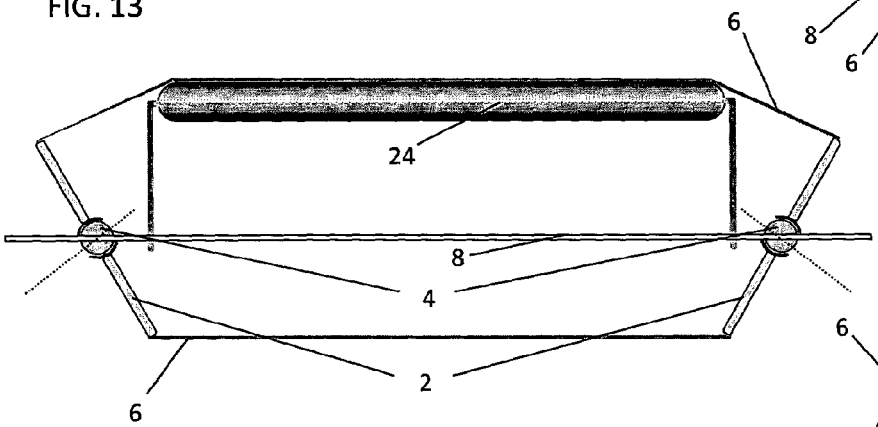
FIG. 13 is a section through a tenth embodiment thereof.
Figure 14:
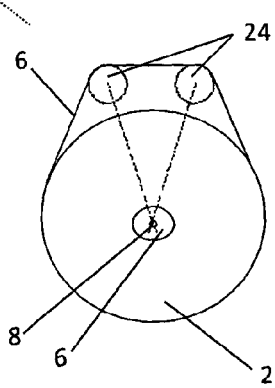
FIG. 14 is a lateral view of the embodiment of FIG. 13.

FIGS. 13 and 14 show how the fixed shaft 8 can be used as a support for motorized rollers 24 in the interior of the elastic sleeve 6. A pair of motorized rollers 24 with tangential velocity respectively less than and greater than that of the elastic sleeve 6 are able to stretch a portion of said sleeve in a longitudinal direction, as shown in FIG. 14. In this manner, web deformation (compaction or stretching) could be also achieved in the longitudinal in addition to transverse direction on a single sleeve. If the motorized rollers 24 rotate at the same tangential velocity as the sleeve 6, a widened nip/support surface is obtained to be able to intervene, for example, with the application of additives (FIG. 14). The additives can be added to the web adhering to the surface of the elastic sleeve from the outside by means of devices known to the state of the art.

Figure 16:
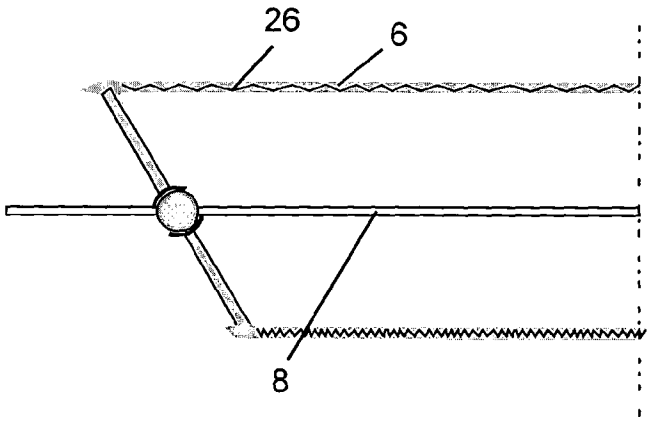
FIG. 16 is a twelfth embodiment thereof.
Figure 15:
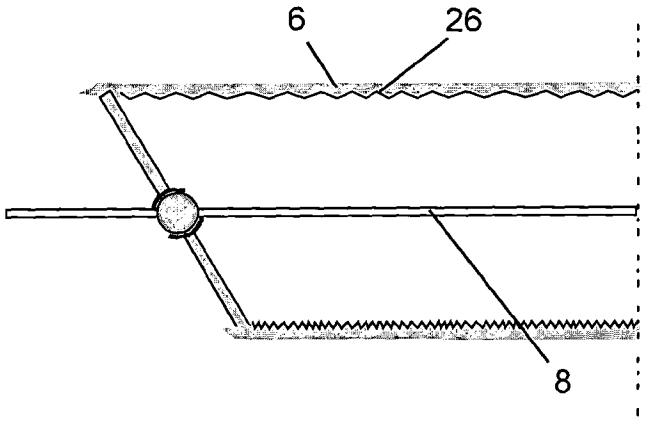
FIG. 15 is a lateral view of an eleventh embodiment thereof.

In FIGS. 15 and 16 the elastic sleeve is supported (FIG. 15) or fixed (FIG. 16) on a reinforcement 26 made of springs.

Figure 18:
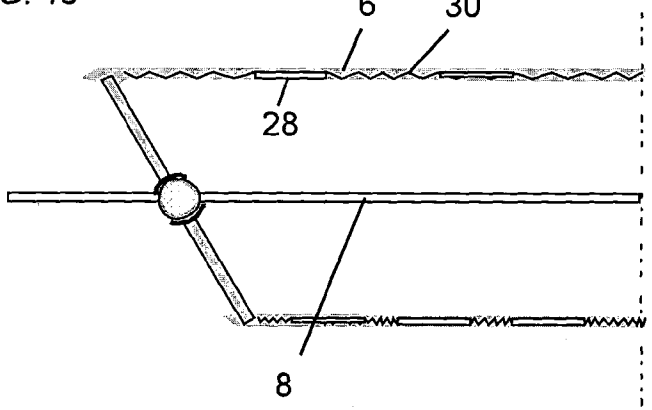
FIG. 18 is a fourteenth embodiment thereof.
Figure 17:
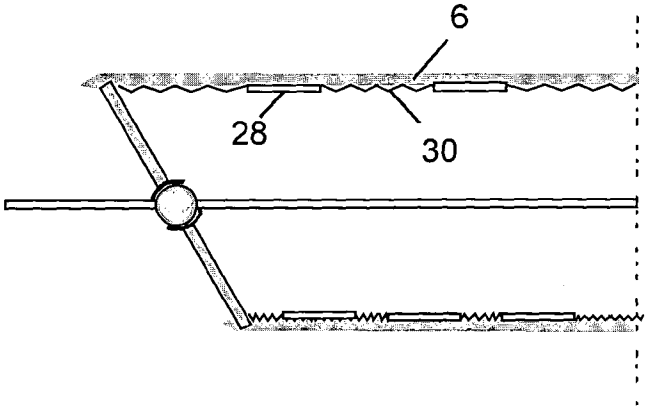
FIG. 17 is a thirteenth embodiment thereof.

In FIGS. 17 and 18 the elastic sleeve is supported (FIG. 17) or fixed (FIG. 18) on a reinforcement composed of rigid elements 28 spaced apart and linked together by springs 30.

These embodiments give greater strength to the elastic return of the sleeve in that the elastomer could lose its elasticity with time and become elongated.

The additives to be added can confer properties such as:

porosity control (surface porosity is essential for determining the capacity to filter ink pigments from their carrier and hence for print quality) along the thickness with additives such as: crystalline microcellulose, nanocellulose, mineral fillers generated in situ by precipitation polyalkyleneglycols (porosity increase; see WO 08/131793);

additives for favoring drainage under pressure (U.S. Pat. No. 7,556,714);

barrier towards oxygen and/or water vapour: proteins (glutins, milk serum derivatives), vinylidene chloride copolymers (CA 711208), nanocellulose, opacity, mineral fillers generated in situ by precipitation, kaolin, mica;

antigrease: starch, nanocellulose, alginates, carboxy methyl cellulose, polyvinylalcohol;

sizing: starch;

softness: non-ionic surfactants, cationic surfactants, anionic surfactants, natural fats, vegetable oils, fatty alcohols, cationic polymers, silicone microemulsions;

perfume/emollient properties: perfumes also in microcapsules, aloe also in microcapsules, essential oils also in microcapsules;

dust control, resistance to delamination, in particular during the printing process: starch, nanocellulose, carboxymethylcellulose;

water repellence (including for capacitor insulating papers easily soakable in dielectric oils or resins): waxes, colophony;

hydrophilicity: polyalkyleneglycols;

ink adhesion: titanium acetyl acetonate, silanes, gum Arabic, dextrins, alum;

antiadherence: silicone resins;

adhesive curing rate, particularly polyurethane based: zinc stearate, caprolactam, N-acylureas WO 05/118666), tertiary amines;

color: pigments in dispersion (particularly titanium dioxide for degree of whiteness), pigments based on optical interference generated by nano layers of polyelectrolytes (for example nano cellulose and polyethylene imine), colorants, including thermal, electro or photo chromic;

voluminosity: microcapsules containing expanding agents that can be activated by heating, nanocellulose based foams, chemical expanding agents;

possible heating by induction: susceptors (preferably biodegradable such as some of those described in U.S. Pat. No. 6,348,679), able to convert electromagnetic energy at radio frequency or microwaves into heat.

In particular the susceptors can be added in mixture with nanocellulose such as to be able to achieve effective drying of this latter;

rigidity and tensile strength (dry and/or wet): starch. nanocellulose, acrylic resins cross-linkable by photo initiators and UV light, melamine resins cross-linkable by heat, polyamide resins modified with epichlorohydrin;

oxygen scavengers: encapsulated substances to function at the required moment, such as ferrous salts;

electrical conductivity: carbon fibers;

antibacterials: silver salts, silver nanoparticles, titanium dioxide, quaternary ammonium salts (or ammonium ions associated with nano cellulose or microcellulose), chitosan, bacteriocins, various natural extracts (from tea, nutmeg, grapefruit, etc.).

In order to favor adhesion of the web to the elastic sleeve, stretch uniformity and water removal from the web of fibrous and/or pliable material, the invention also provides for the use of mechanical presser elements which are fixed or able to rotate, including at differentiated velocity (increase of web voluminosity), provided with low friction surfaces, or of felt pads or other endless belts, including elastic.

As already stated, a suction box can be positioned on the fixed shaft in a position corresponding with that sleeve section in which the web is subjected to deformation in order to improve its adhesion while preventing excess squashing. A watermark can also be obtained if on the elastic sleeve, there are zones of different air permeabilities and/or of different elastic deformability.

To improve adhesion between the web and the elastic surface of the sleeve, said surface can be functionalized such as to present high affinity for the constituent material of the web. For example the web consists of cellulose fibres, the material forming the sleeve can be formed starting from a mixture of elastic material (rubber) and cellulose in the form of fibers, microcrystals (microcrystalline cellulose) or nanofibers (nanocellulose).

Alternatively, the cellulose fibers or nanofibers can be bonded to the elastic surface by suitable binders, such as latex or adhesion promoters based, for example, on silicates and titanates. To improve adhesion between the fibre layer and the rubber, this latter can be subjected to corona treatment or generally to plasma treatment.

An elastic fabric composed partly of cotton can also be used as the material forming the sleeve 6.

The sleeve can also be covered or impregnated with a gum latex of low glass transition temperature, such as those used for pressure-sensitive adhesives, traditionally used for post-it pads. Finally, the sleeve can be covered or impregnated with formulations typically used for increasing the adhesion of the fiber web to the Yankee cylinder used in producing tissue paper; and said sleeve can also comprise on its surface a plurality of microhooks to favor the gripping of the web.

The invention claimed is:

1. A multifunction apparatus for processing a fibrous web comprising:

a tubular sleeve of an elastic material;

a pair of discs for supporting said tubular sleeve, such to form a disc/sleeve system;

a fixed shaft on which said discs are mounted such that an axis of the disks discs is inclinable in relation to an axis of said sleeve, end portions of said shaft extending beyond said discs; and a moving system configured to move the disc/sleeve system relative to said fixed shaft, wherein the tubular sleeve is permeable to fluids.

2. The apparatus as claimed in claim 1, wherein the tubular sleeve comprises tubular systems configured to absorb, release, or circulate fluids in its interior.

3. The apparatus as claimed in claim 1, wherein the fixed shaft is hollow.

4. The apparatus as claimed in claim 1, further comprising an internal suction device facing a fixed portion of an internal surface of the permeable tubular sleeve.

5. The apparatus as claimed in claim 1, further comprising an internal air blowing device facing a fixed portion of an inner surface of the permeable tubular sleeve.

6. The apparatus as claimed in claim 1, further comprising an internal liquid atomization device facing a fixed portion of an inner surface of the permeable tubular sleeve.

7. The apparatus as claimed in claim 1, further comprising an internal device for controlling the temperature of a fixed portion of an inner surface of the permeable tubular sleeve.

8. The apparatus as claimed in claim 1, further comprising a device for producing mechanical or ultrasound vibrations on a surface of the permeable tubular sleeve.

9. The apparatus as claimed in claim 1, wherein zones of the tubular sleeve are of different extensibility.

10. The apparatus as claimed in claim 1, further comprising zones of different fluid permeability on a surface of the tubular sleeve.

11. The apparatus as claimed in claim 1, wherein the tubular sleeve is supported by an elastic reinforcement.

12. The apparatus as claimed in claim 1, wherein the fixed shaft is provided with pushers acting on the tubular sleeve.

13. A multifunction apparatus for processing a fibrous web comprising:

a tubular sleeve of an elastic material;

a pair of discs for supporting said tubular sleeve, such to form a disc/sleeve system;

a fixed shaft on which said discs are mounted such that an axis of the discs is inclinable in relation to an axis of said sleeve, end portions of said shaft extending beyond said discs; and a moving system configured to move the disc/sleeve system relative to said fixed shaft, wherein the tubular sleeve is supported by an elastic reinforcement, and wherein the elastic reinforcement is composed of a helical spring.

14. A multifunction apparatus for processing a fibrous web comprising:

a tubular sleeve of an elastic material;

a pair of discs for supporting said tubular sleeve, such to form a disc/sleeve system;

a fixed shaft on which said discs are mounted such that an axis of the discs is inclinable in relation to an axis of said sleeve, end portions of said shaft extending beyond said discs; and a moving system configured to move the disc/sleeve system relative to said fixed shaft, wherein the tubular sleeve is supported by an elastic reinforcement, and wherein the elastic reinforcement is composed of rigid elements spaced by springs.

* * * * *